United States Patent [19]

Gilliam

[11] 4,056,956

[45] Nov. 8, 1977

[54] TOOL FOR DETERMINING SAFE LOCK COMPONENT POSITIONS

[75] Inventor: Charles David Gilliam, Long Beach, N.Y.

[73] Assignee: New York School of Locksmithing, Inc., Hempstead, N.Y.

[21] Appl. No.: 704,938

[22] Filed: July 13, 1976

[51] Int. Cl.[2] ..... E05B 17/00

[52] U.S. Cl. ..... 70/446; 116/2; 73/139

[58] Field of Search ..... 116/2; 70/446, 442, 70/DIG. 55, DIG. 44, DIG. 12; 73/139

[56] References Cited

U.S. PATENT DOCUMENTS

| | | | |
|---|---|---|---|
| 1,064,608 | 6/1913 | Burt | 116/2 |
| 2,974,517 | 3/1961 | Jacobs | 70/440 X |
| 3,222,922 | 12/1965 | Isaac | 73/139 |
| 3,633,388 | 1/1972 | Atkinson | 70/446 |

*Primary Examiner*—Daniel M. Yasich

*Attorney, Agent, or Firm*—Roylance, Abrams, Berdo & Kaul

[57] ABSTRACT

A tool for assisting in determining the locations of disc gates relative to a tailpiece in a combination lock includes a block mounted on a safe handle, a shaft extending from the block, a first pointer extending from the block along the shaft and a second pointer extending from the block perpendicular to the first pointer and across the safe door. The shaft is manually deflectable relative to the first pointer as torque is applied to the safe handle, the amount of torque being visible from the relative positions of the first pointer and an indicator plate on the shaft. Movement of the second pointer is determined by marking the safe door adjacent that pointer, which movement indicates the location of a gate relative to the tailpiece coupled to the safe handle.

5 Claims, 4 Drawing Figures

TOOL FOR DETERMINING SAFE LOCK COMPONENT POSITIONS

This invention relates to a tool for determining the relative positions of elements within a combinaion lock on a safe and to a method for using the tool.

It is frequently necessary for a locksmith to determine the combination of a safe which is locked and for which the combination has been lost or, for some other reason, is not available. It has previously been necessary for such a locksmith to possess substantial skill and experience and to be extremely sensitive to events within the combination lock in order to perform this task. However, if the gate positions in the discs of a combination lock can be determined, a skilled locksmith can derive the combination from this information, without the tedious and difficult procedures previously necessary.

An object of the present invention is, therefore, to provide a tool which can be employed by a locksmith to determine the gate locations of lock discs in the combination lock, which information can then be used to determine the safe combination.

A further object is to provide a method of employing the tool whereby the positional information can be determined with relatively little experience.

Briefly described, the invention includes a tool for use in determining the locations of gates in the combination lock of a safe of the type having a door with a conbination lock, a combination dial for operating the lock and a rotatable handle having a tailpiece coupled thereto, the tool comprising the combination of a support body, a first pointer mounted on the body and extending therefrom in a first direction, a second pointer mounted on the body and extending therefrom in a second direction separated from the first direction by a predetermined angle, means for mounting the support body on the safe handle with the first and second pointers lying in planes which are substantially parallel with the safe door, an elongated resilient shaft mounted at one end on said support body, the other end of the shaft forming a tool handle, the shaft extending from the body in a direction parallel with the second pointer, the shaft being longer than the second pointer and being sufficiently resilient to permit manual deflection of the shaft relative to said second pointer and to return to the parallel position when released, and means for indicating the magnitude of deflection of the shaft relative to the second pointer.

In order that the manner in which the foregoing and other objects are attained in accordance with the invention can be understood in detail, a particularly advantageous embodiment thereof will be described with reference to the accompanying drawings, which form a part of this specification, and wherein.

Before describing the tool itself in detail, some background information relating to safes of the type under consideration is appropriate. The tool of the present invention is designed particularly for use in determining the combinations of straight tailpiece-type safes. In this form of safe, the safe door is provided with a handle which, when rotated, disengages the latches which keep the door in its locked position, thereby permitting the door to be opened. The combination lock itself has a number of wheels or discs, usually three, each of the wheels having a gate which is in the form of a recess or notch extending inwardly from the periphery of the disc and extending angularly over a predetermined sector. The angular extent of each gate is different from each other gate and the positions of the discs relative to other components of the lock determine the combination itself. A calibrated dial on the exterior of the door rotates the discs by means which need not be described herein. Within the door, there is a latch member attached to the handle and disposed adjacent the discs, this latch member being known as a tailpiece. When the dial is rotated through the proper sequence of numbers according to the calibrations on its base, the gates in the discs are aligned with each other adjacent the tailpiece, thereby permitting the tailpiece to enter the notches and permitting the handle to be rotated to perform the opening function.

The foregoing description is not intended to be an exhaustive treatment of combination locks or safe mechanisms, but is simply provided to put the tool and its use in proper context.

Figure 1:
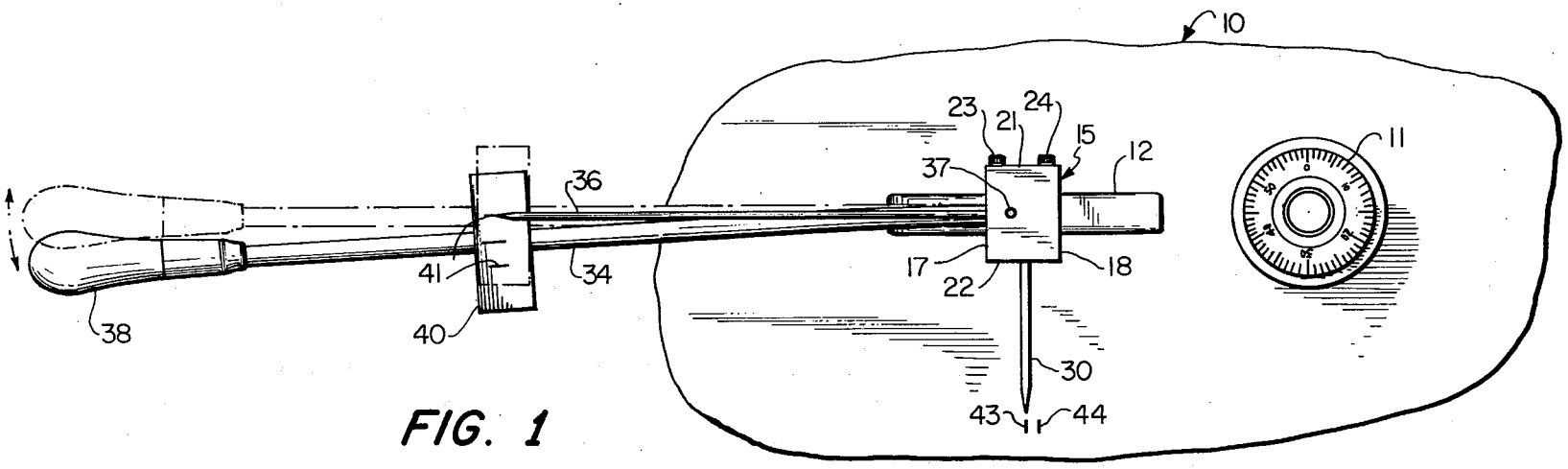
FIG. 1 is a front elevation of a tool in accordance with the invention mounted on a safe.
Figure 2:
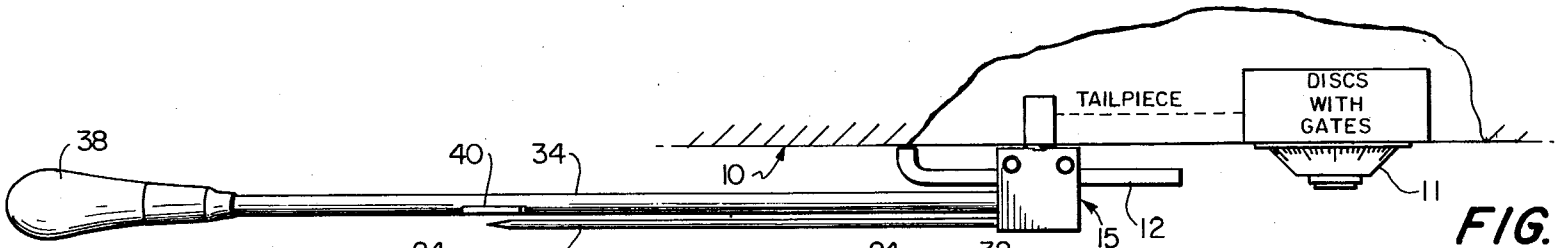
FIG. 2 is a plan view of the apparatus of FIG. 1.
Figure 4:
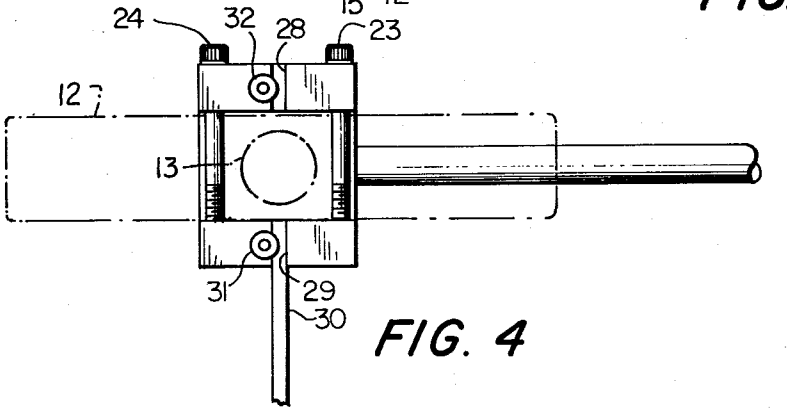
FIG. 4 is a rear elevation of an end portion of the tool of FIGS. 1—3.
Figure 3:
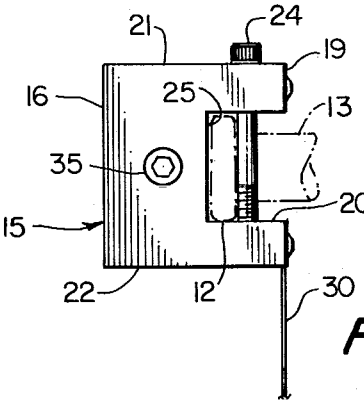
FIG. 3 is an end elevation of the tool of FIGS. 1 and 2.

Now, turning to the figures, it will be seen that FIGS. 1–4 illustrate a portion of a safe door indicated generally at 10 on which there is mounted a dial 11 of a combination lock, which dial is rotatable through sequences of numbers in accordance with the above discussion. A handle 12 is mounted on a shaft 13 so that rotation of the handle, when the lock mechanism has been properly operated, causes rotation of shaft 13 and operates the door lock mechanism, as schematically indicated in FIG. 2.

The tool itself includes a support body 15 which is a metallic body generally in the shape of a cube. Body 15 has a front face 16, end faces 17 and 18 and a back face 19. A generally U-shaped recess 20 extends inwardly into the body from back face 19 and opens at its ends through faces 17 and 18 to permit the body to partially encircle handle 12. The body also has a top face 21 and a bottom face 22 and aligned openings extend through the top and bottom faces and through the portions of the cube forming the upper and lower limits of the recess to receive threaded fasteners 23 and 24, the upper openings being smooth and dimensioned to permit the fasteners to pass therethrough, the bottom openings being internally threaded to engage the external threads of the fasteners. The inner wall 25 of recess 20 is inwardly spaced from the fastener a predetermined distance to receive the handle. Thus, with the fasteners removed the body can be placed over the handle, after which the fasteners are inserted and tightened to firmly clamp the handle within the recess.

Face 19 is also provided with relatively shallow slots 28 and 29, either one of which can receive one end of a flat thin pointer member 30. A threaded fastener 31 having an enlarged head is received in an internally threaded opening in face 19, the head of the fastener overlapping slot 29 to clamp pointer 30 therein. Slot 28 also has a fastener 32 to clamp the pointer in slot 28 when it is being used, the two slots being provided for alternative use depending upon whether the handle is on the right or the left-hand side of the dial .

An elongated resilient shaft 34 is inserted into an opening which extends into body 15 through face 17, the shaft having a threaded opening extending into the end thereof to receive the threaded end of a fastener 35 which is inserted through face 18 of block 15 to firmly secure the end of shaft 34 in the block. A pointer 36, which is in the shape of a relatively long thin rod having a pointed end is inserted into an additional opening through face 17 of block 15 and is secured therein by a set screw 37 which passes through face 16. Shaft 34 and pointer 36 are parallel and aligned with each other and with the longitudinal centerline of handle 12.

At the opposite end of shaft 34 is a handle portion which can be provided with a conventional tool grip 38. Near the distal end of pointer 36 is a torque or pressure-indicating plate 40. Plate 40 is fixedly attached to shaft 34 and is provided with calibration indicia 41 to indicate the postion of shaft 34 relative to pointer 36.

As illustrated in FIG. 1, shaft 34 can be deflected from its normal location, indicated in phantom lines, in which the shaft is parallel with pointer 36. This deflection is accomplished by manually grasping handle 38 and exerting downward (or upward) pressure on the handle, causing the shaft to flex and to curve away from its parallel condition. The shaft is sufficiently resilient to restore it to the parallel condition when released. The amount of torque applied by this pressure on the handle is indicated by the position of the pointed end of pointer 36 relative to plate 40, the degree of force being accurately indicated by the calibrations 41 on plate 40.

Pointer 30, however, moves only when the handle and the block 15 clamped to the handle moves. When used to determine the combination of a safe, handle 38 is depressed until pointer 36 is aligned with one of the indicia on plate 40. A small pencil mark as indicated at 43 is then made on the door of the safe adjacent the pointed end of pointer 30. This position indicates the normal position of the handle, with any lost motion having been absorbed by the initial movement.

Thereafter, when the safe dial is rotated to a position wherein a gate in one of the lock discs is aligned with the tailpiece, the handle will move to a different position such as, for example, that indicated by mark 44 with the same torque applied to shaft 34. This difference in movement indicates to the operator that the tailpiece is adjacent a disc gate and that, therefore, the dial is set to one of the number of the combination. By proceeding through an orderly sequence of steps of movement of the dial and application of pressure to cause deflection of shaft 34, and simultaneous observation of the degree of deflection of pointer 30, the operator can determine the location of each of the lock gates. By recording the numbers at which each of these gates is identified, the combinatiion can be ascertained.

While it is believed that the use of the tool should be apparent from the foregoing, an example thereof will be given.

The flat metal strip comprising pointer 30 is first inserted in one of slots 28 and 29 and is clamped therein. Fasteners 23 and 24 are then removed and recess 20 of the body is placed over the handle 12 with the center of the body aligned with the axis of shaft 13, and the fasteners are replaced in their openings, one on each side of shaft 13, and tightened.

Handle 38 is then lifted to relieve the pressure on the safe lock and the dial 11 is rotated four times to the left (counterclockwise), ending on number 60 of the dial, which is normally calibrated with numbers from zero to 100. A slight downward pressure is then applied to handle 38 and the dial is slowly turned to the right (clockwise). The downward pressure should be sufficient so that a drag on the dial can be felt but not so heavy as to prevent dial movement. As the dial is turned, there will come a point at which the tailpiece can be felt to enter the gate on the third disc. The dial can then be turned back and forth, without drag, through a limited arc defined by about four to six numbers on the dial . This area defines the location of one of the disc gates. The center of this arc gives the third number of the lock combination.

The dial can then be turned to that number through three clockwise revolutions of the dial and handle 38 depressed until pointer 36 is aligned with the upper one of marks 41 on plate 40. A pencil mark is then made on the safe door opposite the pointed end of pointer 30. The pressure is then removed from handle 38 and the dial is rotated through successive small increments (e.g., $2\frac{1}{2}$ numbers), and back to the third number previously found, applying pressure to the same mark on plate 40 and checking the position of pointer 30 relative to the pencil mark after each increment of movement. The largest change indicates another gate position.

By continuing procedures based on the above, gate positions for the entire lock can be located.

While certain advantageous embodiments have been chosen to illustrate the invention, it will be understood by those skilled in the art that various changes and modifications can be made therein without departing from the scope of the invention as defined in the appended claims.

What is claimed is:

1. A tool for use in determining the locations of gates in the combination lock of a safe of the type having a door with a combination lock, a combination dial for operating the lock and a rotatable handle having a tailpiece coupled thereto, the tool comprising the combination of a support body;

a first pointer mounted on said body and extending therefrom in a first direction;

a second pointer mounted on said body and extending therefrom in a second direction separated from said first direction by a predetermined angle;

means for mounting said support body on the safe handle with said first and second pointers lying in planes which are substantially parallel with the safe door;

an elongated resilient shaft mounted at one end on said support body, the other end of said shaft forming a tool handle, said shaft extending from said body in a direction parallel with said second pointer, said shaft being longer than said second pointer and being sufficiently resilient to permit manual deflection of said shaft relative to said second pointer and to return to said parallel position when released; and means for indicating the magnitude of deflection of said shaft relative to said second pointer.

2. A tool according to claim 1 wherein said predetermined angle is about 90°.

3. A tool according to claim 1 wherein said means for indicating comprises a plate mounted on said shaft in the plane of deflection thereof, said plate having indicia on the surface facing said second pointer.

4. A tool according to claim 1 wherein said support body comprises a block generally in the shape of a cube; and said means for mounting includes means defining a generally U-shaped recess in one side of said block for receiving said safe handle, and threaded fastener means extending through said cube and across the open side of said recess for encompassing said handle.

5. A tool according to claim 4 wherein said first pointer includes a flat metal strip having a pointed end, and wherein said cube further includes a groove dimensioned to receive said strip, said groove extending across at least a portion of the face of said cube into which said recess extends and perpendicular to said recess; and means for clamping said strip in said groove.

* * * * *